US011504601B1

(12) United States Patent
Chen

(10) Patent No.: US 11,504,601 B1
(45) Date of Patent: Nov. 22, 2022

(54) COMBINATION RAMP SYSTEM FOR SPORTS

(71) Applicant: Wang-Chuan Chen, Taichung (TW)

(72) Inventor: Wang-Chuan Chen, Taichung (TW)

( * ) Notice: Subject to any disclaimer, the term of this patent is extended or adjusted under 35 U.S.C. 154(b) by 0 days.

(21) Appl. No.: 17/352,454

(22) Filed: Jun. 21, 2021

(51) Int. Cl.
*A63C 19/10* (2006.01)
*A63C 19/00* (2006.01)

(52) U.S. Cl.
CPC ..... *A63C 19/10* (2013.01); *A63C 2203/00* (2013.01)

(58) Field of Classification Search
CPC ..... A63C 17/00; A63C 19/00; A63C 19/10; A63C 2201/02; A63G 7/00
USPC ..... 472/89, 90, 92; 14/69.5
See application file for complete search history.

(56) References Cited

U.S. PATENT DOCUMENTS 9,675,869 B1 * 6/2017 Chin ..... A63C 19/10
2003/0125120 A1 * 7/2003 Montolio ..... A63C 19/10 472/89
2010/0311510 A1 * 12/2010 Dickson ..... A63C 19/10 472/89
2016/0279457 A1 * 9/2016 Adams ..... A63B 17/00

FOREIGN PATENT DOCUMENTS

CN 208405991 U 1/2019

* cited by examiner

*Primary Examiner* — Kien T Nguyen
(74) *Attorney, Agent, or Firm* — Karin L. Williams; Alan D. Kamrath; Mayer & Williams PC

(57) ABSTRACT

A combination ramp system includes a first ramp, a second ramp, a connecting assembly, and a shelf board assembly. The first ramp has a first connecting portion. The second ramp has a second connecting portion. The connecting assembly includes a first connecting member and a second connecting member. The first connecting member is provided with a first overlap groove abutting against the first connecting portion and a second overlap groove. The second connecting member is provided with a third overlap groove abutting against the second connecting portion and a fourth overlap groove. The shelf board assembly includes a first shelf board abutting against the second overlap groove, and a second shelf board abutting against the fourth overlap groove.

7 Claims, 7 Drawing Sheets

COMBINATION RAMP SYSTEM FOR SPORTS

BACKGROUND OF THE INVENTION

The present invention relates to a ramp system for sports and, more particularly, to a combination ramp system for sports.

China Patent Application No. 201821106343.6 discloses a sport equipment overlap joint bridge and combination with ramps thereof including a top face and a bottom face. The top face is provided with a first end and a second end opposite to the first end. The bottom face is projectingly provided with a first positioning column and a second positioning column. The first positioning column is adjacent to the first end, and the second positioning column is adjacent to the second end. One end of the first positioning column opposite to the top face is projectingly provided with a first threaded column. One end of the second positioning column opposite to the top face is projectingly provided with a second threaded column. The first threaded column is threaded connected with a first fastening member and sleeved with a first anti-loose member disposed at a side of the first fastening member opposite to the top face. The second threaded column is threaded connected with a second fastening member and sleeved with a second anti-loose member disposed at a side of the second fastening member opposite to the top face.

However, when the above overlap joint bridge is assembled between two ramps, the two ramps must be quite close due to the size of the overlap joint bridge. If the size of the overlap joint bridge is increased, the overlap joint bridge will easily depressed or even break due to the weight of the user.

BRIEF SUMMARY OF THE INVENTION

An objective of the present invention is to provide a ramp system including a first ramp, a second ramp, a connecting assembly, and a shelf board assembly. The first ramp has a first connecting portion. The second ramp has a second connecting portion. The connecting assembly includes a first connecting member and a second connecting member. One side of the first connecting member is provided with a first overlap groove and another side of the first connecting member is provided with a second overlap groove. The first overlap groove abuts against the first connecting portion. One side of the second connecting member is provided with a third overlap groove and another side of the second connecting member is provided with a fourth overlap groove. The third overlap groove abuts against the second connecting portion. The shelf board assembly includes a first shelf board and a second shelf board. One end of the first shelf board is provided with a third connecting portion and another end of the first shelf board is provided with a fifth overlap groove. One end of the second shelf board is provided with a fourth connecting portion and another end of the second shelf board is provided with a sixth overlap groove. The fourth connecting portion abuts against the fourth overlap groove. The sixth overlap groove is abutted against the fifth overlap groove. The first, second, third, fourth, fifth and sixth overlap grooves are respectively extend in a horizontal direction.

In an example, an inner periphery of the fifth overlap groove is provided with a plurality of first tenon members. An inner periphery of the sixth overlap groove is provided with a plurality of first inserting holes. The plurality of first tenon members insert within the plurality of first inserting holes.

In an example, the first connecting portion is provided with a plurality of second inserting holes. The second connecting portion is provided with a plurality of third inserting holes. An inner periphery of the first overlap groove is provided with a plurality of second tenon members inserting within the plurality of second inserting holes. An inner periphery of the third overlap groove is provided with a plurality of third tenon members inserting within the plurality of third inserting holes. An inner periphery of the second overlap groove is provided with a plurality of fourth inserting holes. An inner periphery of the fourth overlap groove is provided with a plurality of fifth inserting holes. A top edge of the first shelf board is provided with a first top face and a bottom edge of the first shelf board is provided with a first bottom face in a vertical direction. The fifth overlap groove is adjacent to the first bottom face. The first bottom face is provided with a plurality of fourth tenon members inserting within the plurality of fourth inserting holes. A top edge of the second shelf board is provided with a second top face adjacent to the first top face and a bottom edge of the second shelf board is provided with a second bottom face adjacent to the first bottom face in the vertical direction. The sixth overlap groove is adjacent to the second top face. The second bottom face is provided with a plurality of fifth tenon members inserting within the plurality of fifth inserting holes.

In an example, the shelf board assembly includes a supporting stem arranged between the first ramp and the second ramp. The supporting stem is connected the first bottom face and the second bottom face.

In an example, the supporting stem includes a baseplate, a first stationary rod, a second stationary rod, a first lifting rod, and a second lifting rod. The first stationary rod and the second stationary rod are fixed on the baseplate in the vertical direction. The first lifting rod is telescopically connected to the first stationary rod in the vertical direction. The second lifting rod is telescopically connected to the second stationary rod in the vertical direction. The first stationary rod is provided with a plurality of first adjusting holes. The second stationary rod is provided with a plurality of second adjusting holes. The first lifting rod is provided with a first fixing hole. The second lifting rod is provided with a second fixing hole. The supporting stem includes a first pin and a second pin. The first pin inserts through one of the plurality of first adjusting holes and the first fixing hole. The second pin inserts through one of the plurality of second adjusting holes and the second fixing hole.

In an example, a bottom edge of the first ramp is provided with a third bottom face in the vertical direction. A first height is formed between the first connecting portion and the third bottom face in the vertical direction. A bottom edge of the second ramp is provided with a fourth bottom face in the vertical direction. A second height is formed between the second connecting portion and the fourth bottom face in the vertical direction. The second height is equal to the first height.

In another example, a bottom edge of the first ramp is provided with a third bottom face in the vertical direction. A first height is formed between the first connecting portion and the third bottom face in the vertical direction. A bottom edge of the second ramp is provided with a fourth bottom face in the vertical direction. A second height is formed between the second connecting portion and the fourth bottom face in the vertical direction. The second height is equal to the first height. The second height is less than the first height.

The present invention will become clearer in light of the following detailed description of illustrative embodiments of this invention described in connection with the drawings.

DETAILED DESCRIPTION OF THE INVENTION

Figure 1:
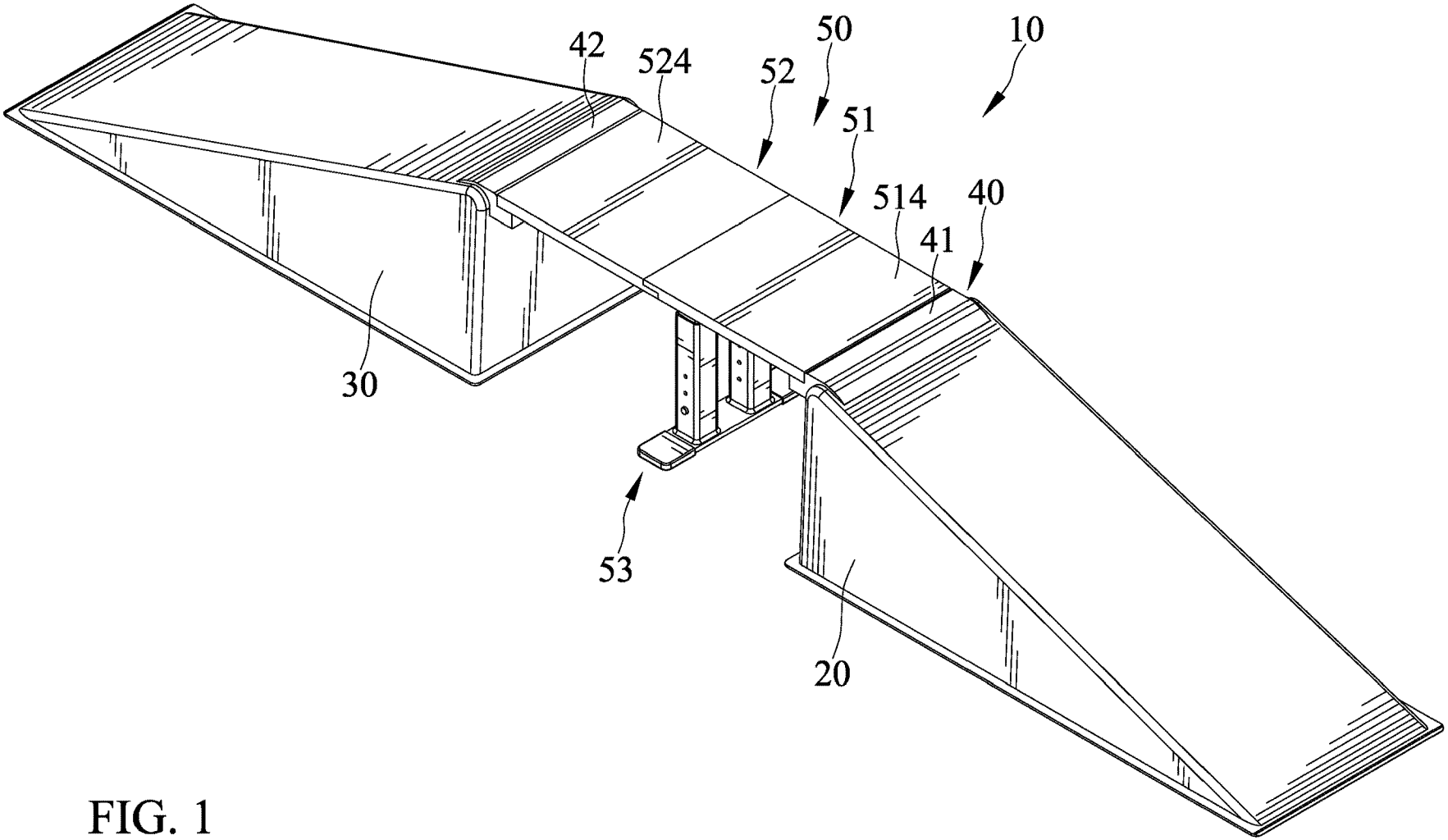
FIG. 1 is a perspective view of a combination ramp system for sports of a first embodiment according to the present invention.
Figure 2:
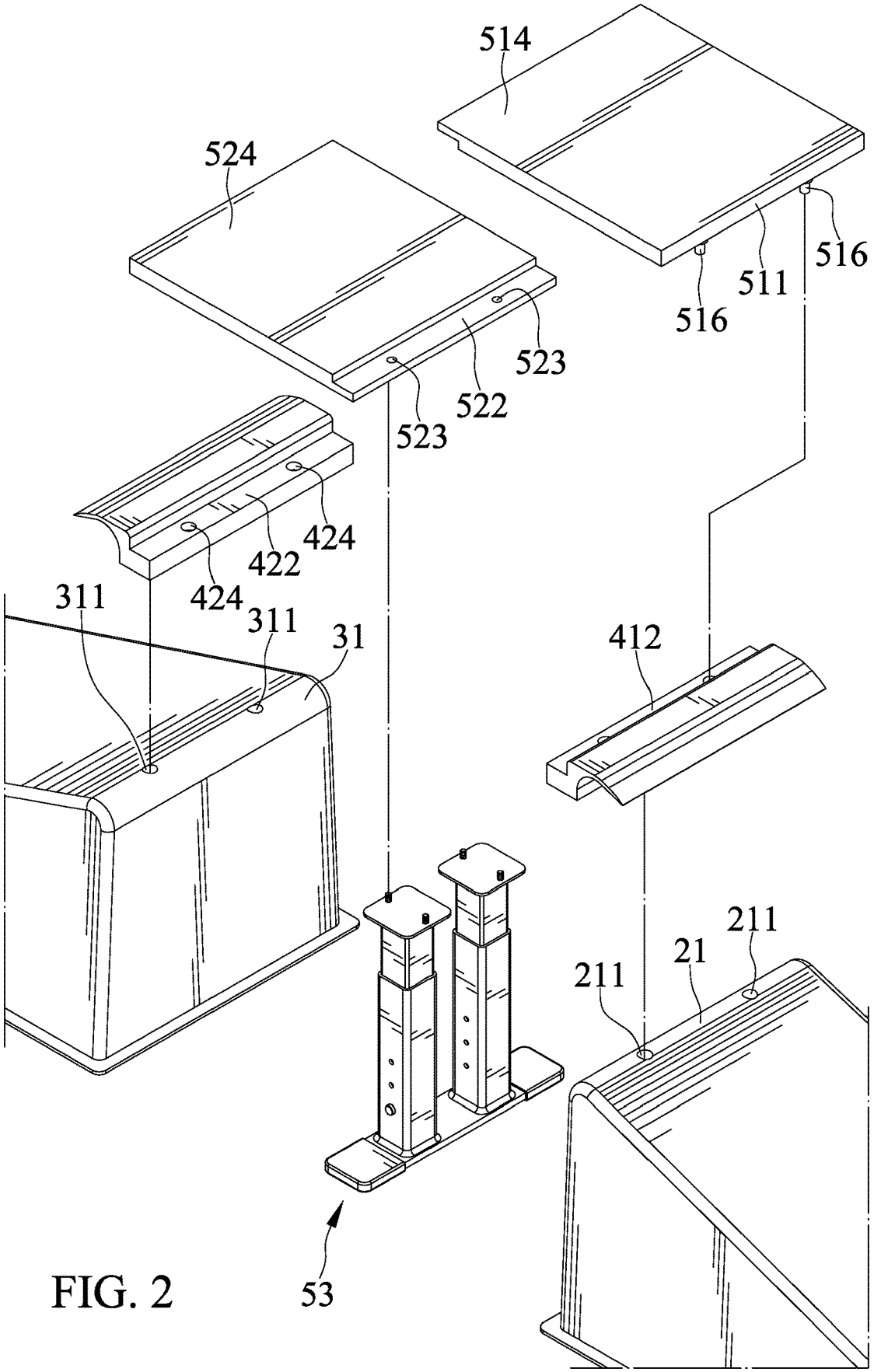
FIG. 2 is a partial, exploded, perspective view of the combination ramp system of FIG. 1.
Figure 3:
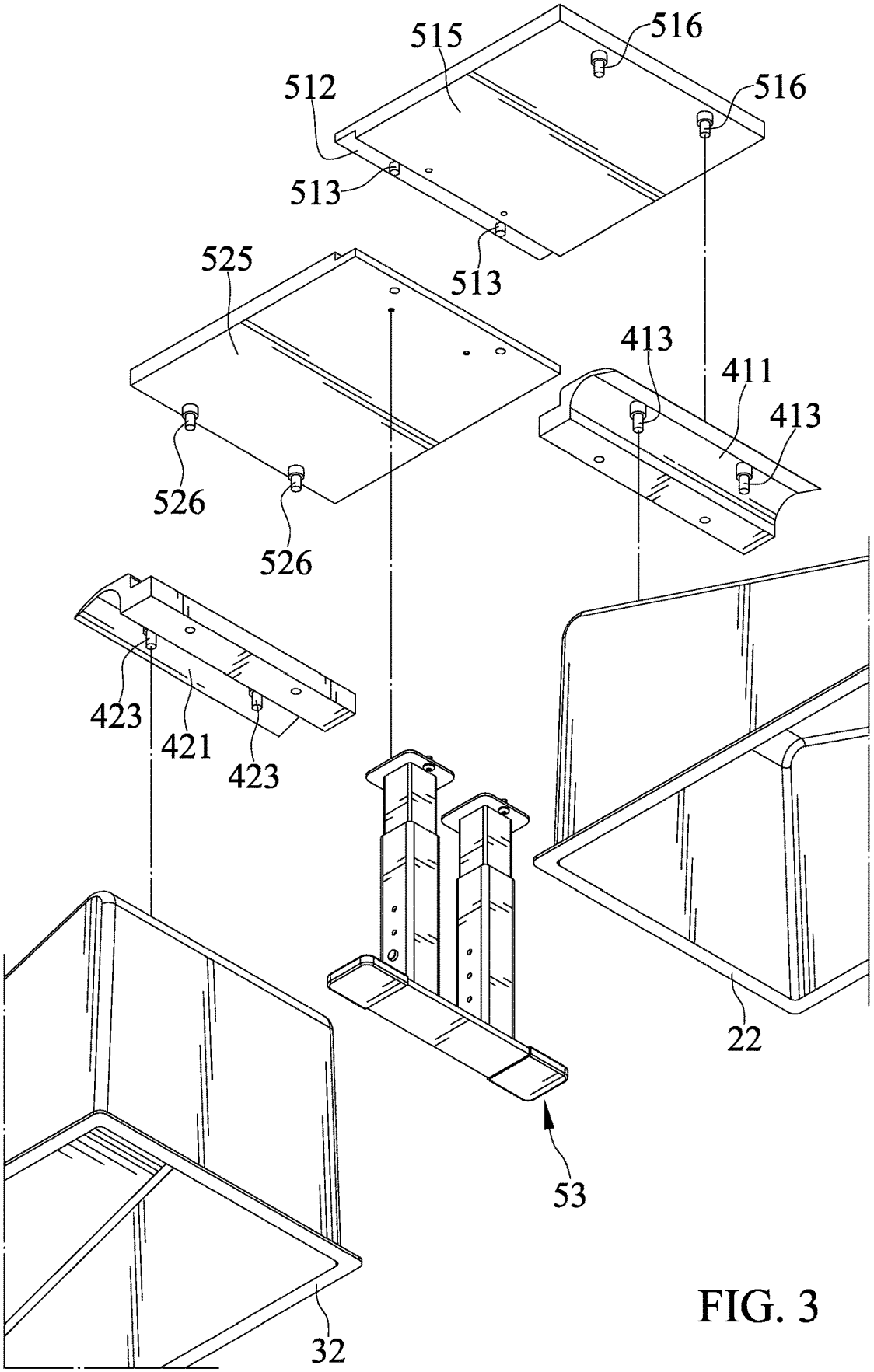
FIG. 3 is another partial, exploded, perspective view of the combination ramp system of FIG. 1.
Figure 4:
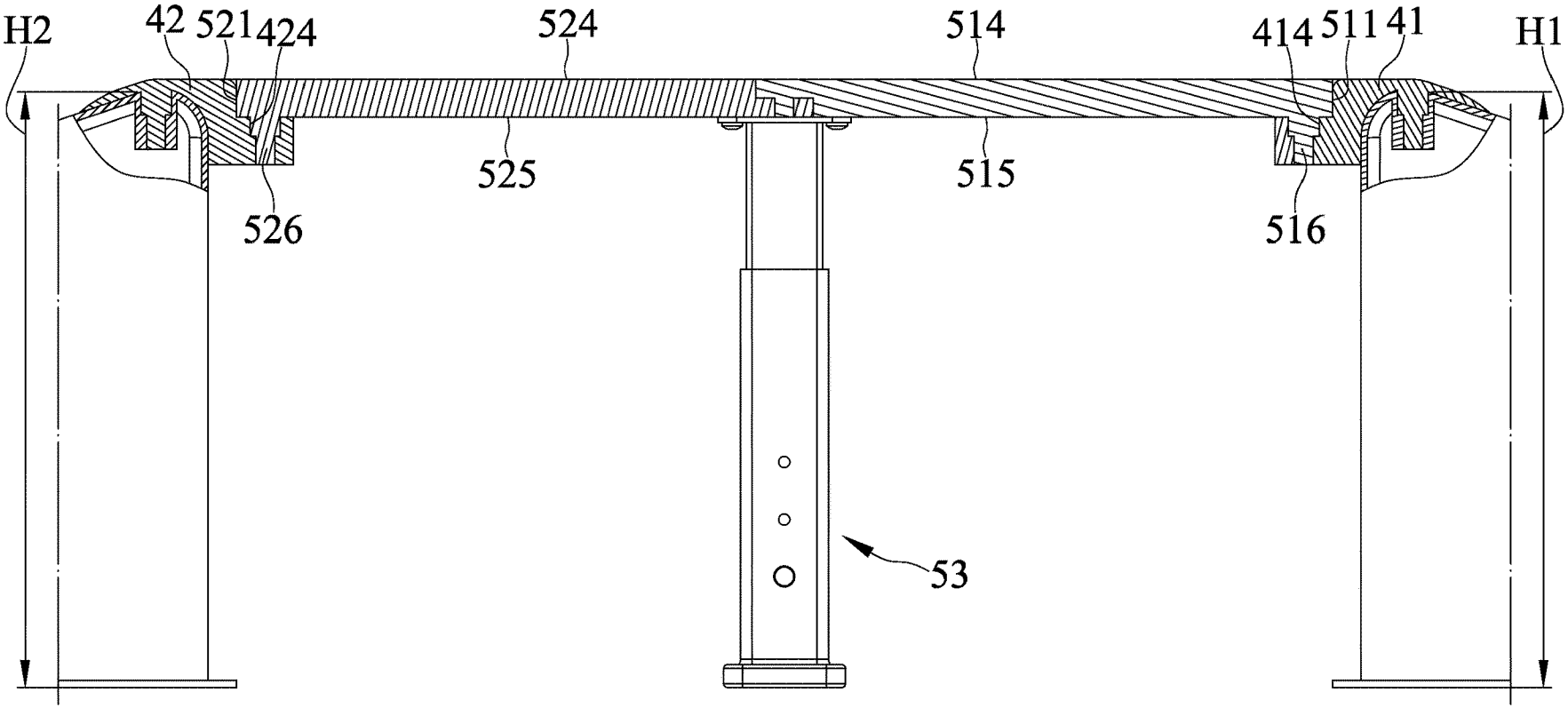
FIG. 4 is a partial, cross sectional view of the combination ramp system of FIG. 1.
Figure 5:
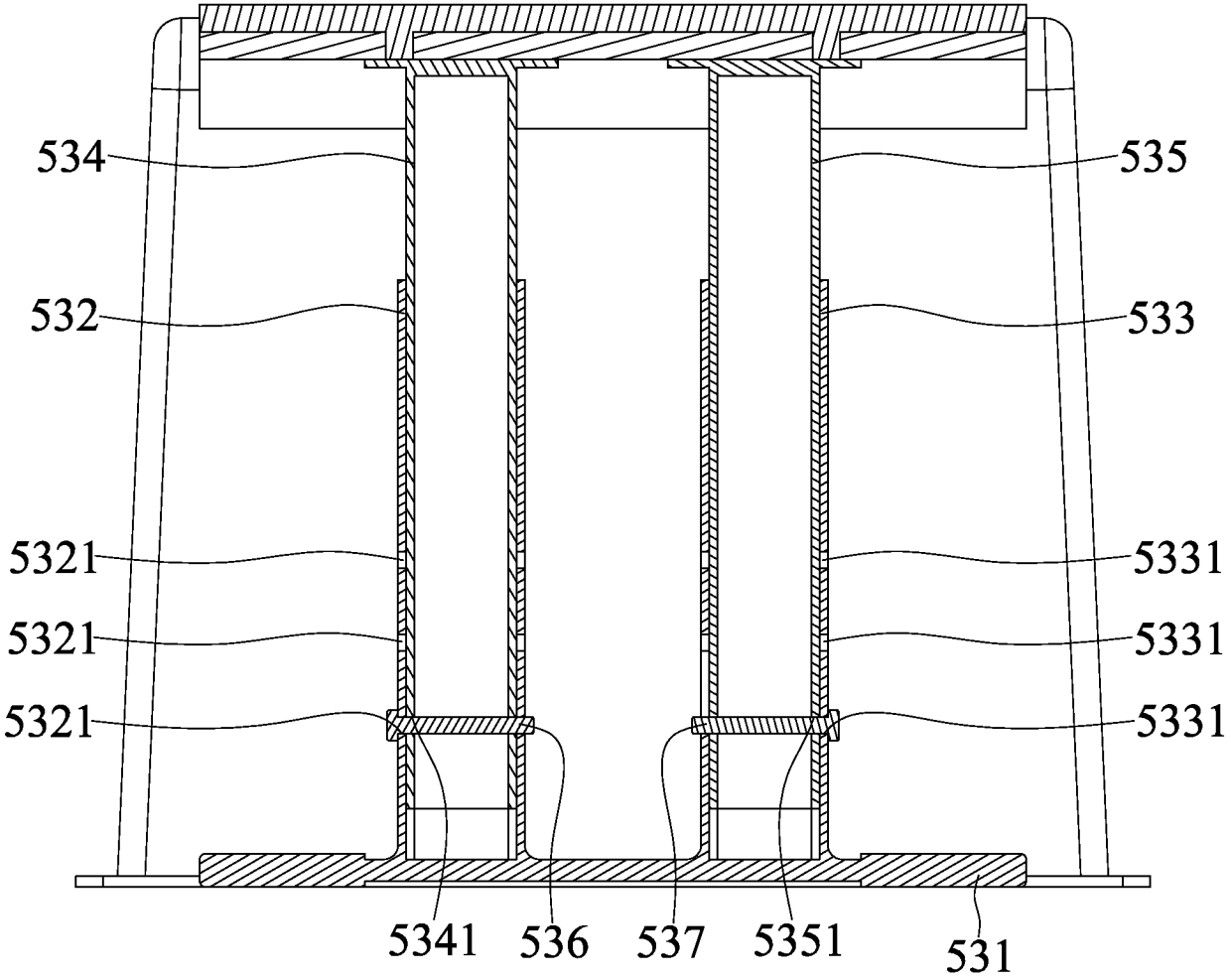
FIG. 5 is another partial, cross sectional view of the combination ramp system of FIG. 1.

FIGS. 1-5 show a combination ramp system 10 for sports of a first embodiment according to the present invention including a first ramp 20, a second ramp 30, a connecting assembly 40, and a shelf board assembly 50.

The first ramp 20 is provided with a first connecting portion 21.

The second ramp 30 is provided with a second connecting portion 31.

The connecting assembly 40 includes a first connecting member 41 and a second connecting member 42. One side of the first connecting member 41 is provided with a first overlap groove 411, and another side of the first connecting member 41 is provided with a second overlap groove 412. The first overlap groove 411 abuts against the first connecting portion 21. One side of the second connecting member 42 is provided with a third overlap groove 421, and another side of the second connecting member 42 is provided with a fourth overlap groove 422. The third overlap groove 421 abuts against the second connecting portion 31.

The shelf board assembly 50 includes a first shelf board 51 and a second shelf board 52. One end of the first shelf board 51 is provided with a third connecting portion 511, and another end of the first shelf board 51 is provided with a fifth overlap groove 512. One end of the second shelf board 52 is provided with a fourth connecting portion 521, and another end of the second shelf board 52 is provided with a sixth overlap groove 522. The fourth connecting portion 521 abuts against the fourth overlap groove 422. The sixth overlap groove 522 is abutted against the fifth overlap groove 512. The first, second, third, fourth, fifth and sixth overlap grooves 411, 412, 421, 422, 512, and 522 are respectively extend in a horizontal direction.

An inner periphery of the fifth overlap groove 512 is provided with a plurality of first tenon members 513. An inner periphery of the sixth overlap groove 522 is provided with a plurality of first inserting holes 523. The plurality of first tenon members 513 insert within the plurality of first inserting holes 523.

The first connecting portion 21 is provided with a plurality of second inserting holes 211. The second connecting portion 31 is provided with a plurality of third inserting holes 311.

An inner periphery of the first overlap groove 411 is provided with a plurality of second tenon members 413 inserting within the plurality of second inserting holes 211. An inner periphery of the third overlap groove 421 is provided with a plurality of third tenon members 423 inserting within the plurality of third inserting holes 311. An inner periphery of the second overlap groove 412 is provided with a plurality of fourth inserting holes 414. An inner periphery of the fourth overlap groove 422 is provided with a plurality of fifth inserting holes 424.

A top edge of the first shelf board 51 is provided with a first top face 514, and a bottom edge of the first shelf board 51 is provided with a first bottom face 515 in a vertical direction. The fifth overlap groove 512 is adjacent to the first bottom face 515. The first bottom face 515 is provided with a plurality of fourth tenon members 516 inserting within the plurality of fourth inserting holes 414. A top edge of the second shelf board 52 is provided with a second top face 524 adjacent to the first top face 514, and a bottom edge of the second shelf board 52 is provided with a second bottom face 525 adjacent to the first bottom face 515 in the vertical direction. The sixth overlap groove 522 is adjacent to the second top face 524. The second bottom face 525 is provided with a plurality of fifth tenon members 526 inserting within the plurality of fifth inserting holes 424.

The shelf board assembly 50 includes a supporting stem 53 arranged between the first ramp 20 and the second ramp 30. The supporting stem 53 is connected the first bottom face 515 and the second bottom face 525.

The supporting stem 53 includes a baseplate 531, a first stationary rod 532, a second stationary rod 533, a first lifting rod 534, and a second lifting rod 535. The first stationary rod 532 and the second stationary rod 533 are fixed on the baseplate 531 in the vertical direction.

The first lifting rod 534 is telescopically connected to the first stationary rod 532 in the vertical direction. The second lifting rod 535 is telescopically connected to the second stationary rod 533 in the vertical direction.

The first stationary rod 532 is provided with a plurality of first adjusting holes 5321. The second stationary rod 533 is provided with a plurality of second adjusting holes 5331.

The first lifting rod 534 is provided with a first fixing hole 5341. The second lifting rod 535 is provided with a second fixing hole 5351.

The supporting stem 53 includes a first pin 536 and a second pin 537. The first pin 536 inserts through one of the plurality of first adjusting holes 5321 and the first fixing hole 5341. The second pin 537 inserts through one of the plurality of second adjusting holes 5331 and the second fixing hole 5351.

A bottom edge of the first ramp 20 is provided with a third bottom face 22 in the vertical direction. A first height H1 is formed between the first connecting portion 21 and the third bottom face 22 in the vertical direction.

A bottom edge of the second ramp 30 is provided with a fourth bottom face 32 in the vertical direction. A second height H2 is formed between the second connecting portion 31 and the fourth bottom face 32 in the vertical direction. and the second height H2 is equal to the first height H1.

Thus, the combination ramp system 10 according to the present invention provides a versatile skating environment between the two ramps 20 and 30 for sportspersons through the above structure, and provides good structural strength.

Figure 6:
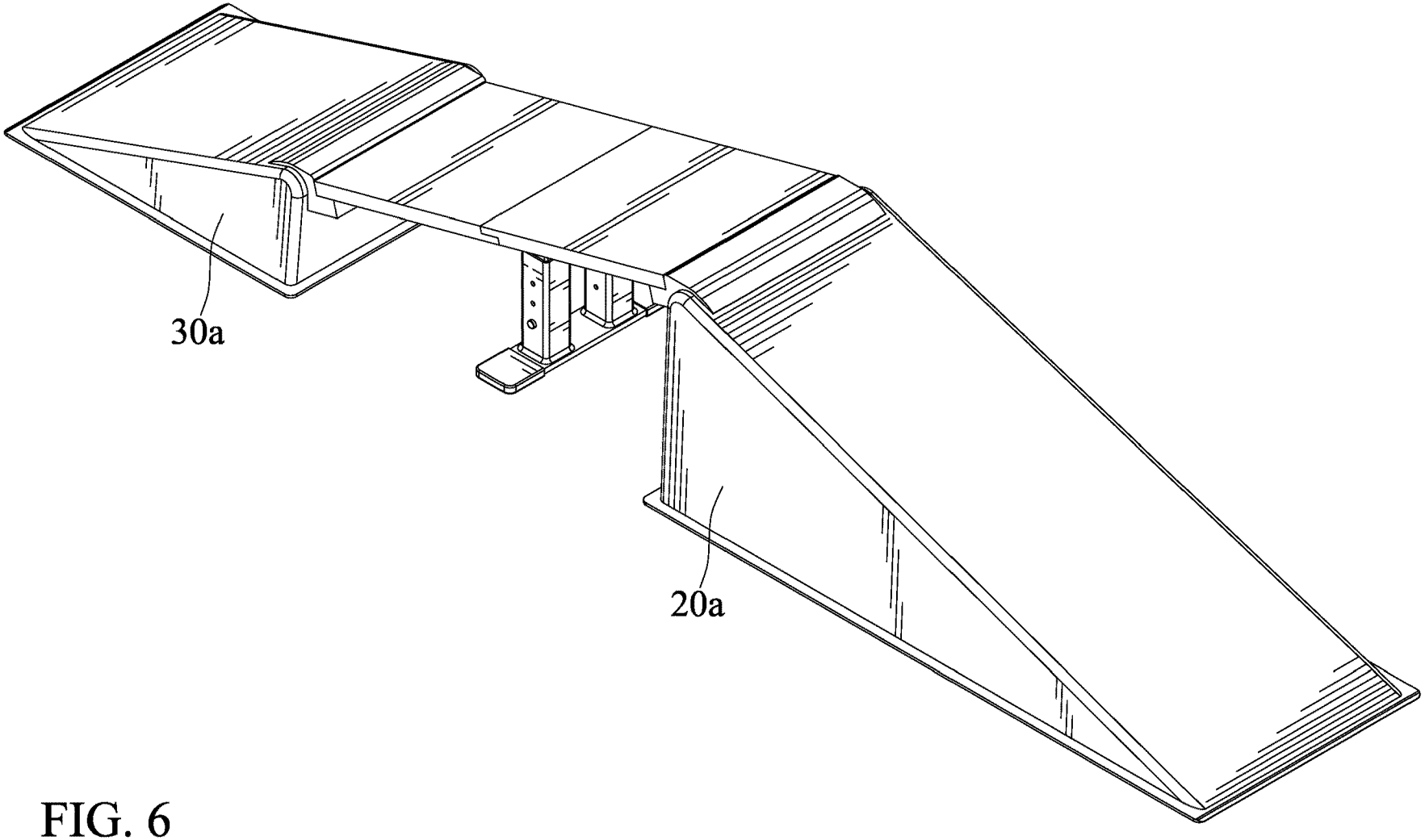
FIG. 6 is a perspective view of a combination ramp system for sports of a second embodiment according to the present invention.
Figure 7:
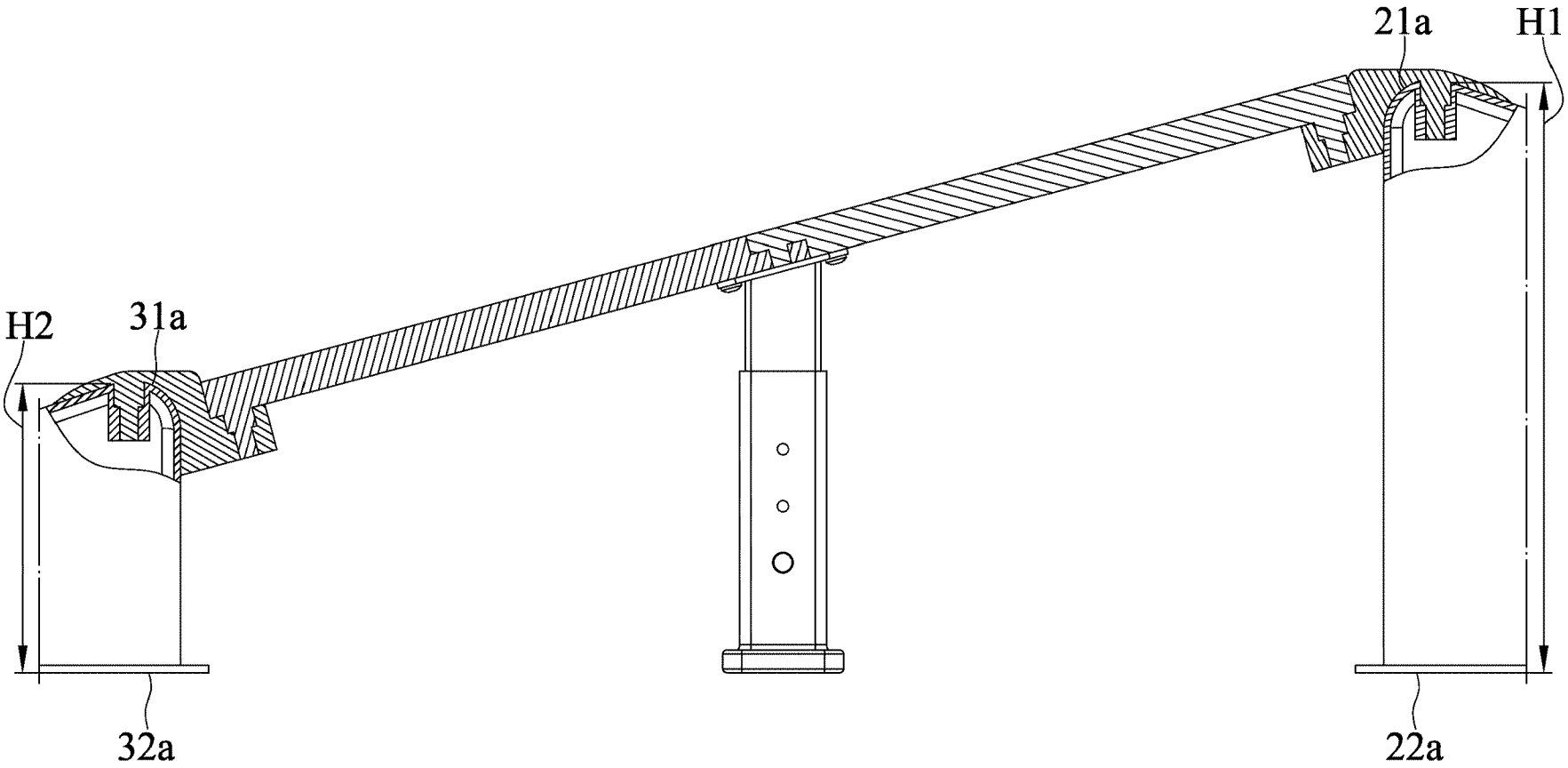
FIG. 7 is a partial, cross sectional view of the combination ramp system of FIG. 6.

FIGS. 6 and 7 show a combination ramp system for sports of a second embodiment according to the present invention. The second embodiment is substantially the same as the first embodiment except that a bottom edge of the first ramp 20*a* is provided with a third bottom face 22*a* in the vertical direction, and a first height H1 is formed between the first connecting portion 21*a* and the third bottom face 22*a* in the vertical direction. A bottom edge of the second ramp 30*a* is provided with a fourth bottom face 32*a* in the vertical direction. A second height H2 is formed between the second connecting portion 31*a* and the fourth bottom face 32*a* in the vertical direction. and the second height H2 is less than the first height H1.

Although specific embodiments have been illustrated and described, numerous modifications and variations are still possible without departing from the scope of the invention. The scope of the invention is limited by the accompanying claims.

The invention claimed is:

1. A combination ramp system comprising:

a first ramp having a first connecting portion;

a second ramp having a second connecting portion;

a connecting assembly including a first connecting member and a second connecting member, wherein one side of the first connecting member is provided with a first overlap groove and another side of the first connecting member is provided with a second overlap groove, wherein the first overlap groove abuts against the first connecting portion, wherein one side of the second connecting member is provided with a third overlap groove and another side of the second connecting member is provided with a fourth overlap groove, and wherein the third overlap groove abuts against the second connecting portion; and a shelf board assembly including a first shelf board and a second shelf board, wherein one end of the first shelf board is provided with a third connecting portion and another end of the first shelf board is provided with a fifth overlap groove, wherein one end of the second shelf board is provided with a fourth connecting portion and another end of the second shelf board is provided with a sixth overlap groove, wherein the fourth connecting portion abuts against the fourth overlap groove, wherein the sixth overlap groove is abutted against the fifth overlap groove, and wherein the first, second, third, fourth, fifth and sixth overlap grooves are respectively extend in a horizontal direction.

2. The combination ramp system as claimed in claim 1, wherein an inner periphery of the fifth overlap groove is provided with a plurality of first tenon members, wherein an inner periphery of the sixth overlap groove is provided with a plurality of first inserting holes, and wherein the plurality of first tenon members insert within the plurality of first inserting holes.

3. The combination ramp system as claimed in claim 2, wherein the first connecting portion is provided with a plurality of second inserting holes, wherein the second connecting portion is provided with a plurality of third inserting holes, wherein an inner periphery of the first overlap groove is provided with a plurality of second tenon members inserting within the plurality of second inserting holes, wherein an inner periphery of the third overlap groove is provided with a plurality of third tenon members inserting within the plurality of third inserting holes, wherein an inner periphery of the second overlap groove is provided with a plurality of fourth inserting holes, wherein an inner periphery of the fourth overlap groove is provided with a plurality of fifth inserting holes, wherein a top edge of the first shelf board is provided with a first top face and a bottom edge of the first shelf board is provided with a first bottom face in a vertical direction, wherein the fifth overlap groove is adjacent to the first bottom face, wherein the first bottom face is provided with a plurality of fourth tenon members inserting within the plurality of fourth inserting holes, wherein a top edge of the second shelf board is provided with a second top face adjacent to the first top face and a bottom edge of the second shelf board is provided with a second bottom face adjacent to the first bottom face in the vertical direction, wherein the sixth overlap groove is adjacent to the second top face, wherein the second bottom face is provided with a plurality of fifth tenon members inserting within the plurality of fifth inserting holes.

4. The combination ramp system as claimed in claim 3, wherein the shelf board assembly includes a supporting stem arranged between the first ramp and the second ramp, and wherein the supporting stem is connected the first bottom face and the second bottom face.

5. The combination ramp system as claimed in claim 4, wherein the supporting stem includes a baseplate, a first stationary rod, a second stationary rod, a first lifting rod, and a second lifting rod, wherein the first stationary rod and the second stationary rod are fixed on the baseplate in the vertical direction, wherein the first lifting rod is telescopically connected to the first stationary rod in the vertical direction, wherein the second lifting rod is telescopically connected to the second stationary rod in the vertical direction, wherein the first stationary rod is provided with a plurality of first adjusting holes, wherein the second stationary rod is provided with a plurality of second adjusting holes, wherein the first lifting rod is provided with a first fixing hole, wherein the second lifting rod is provided with a second fixing hole, wherein the supporting stem includes a first pin and a second pin, wherein the first pin inserts through one of the plurality of first adjusting holes and the first fixing hole, and wherein the second pin inserts through one of the plurality of second adjusting holes and the second fixing hole.

6. The combination ramp system as claimed in claim 5, wherein a bottom edge of the first ramp is provided with a third bottom face in the vertical direction, wherein a first height is formed between the first connecting portion and the third bottom face in the vertical direction, wherein a bottom edge of the second ramp is provided with a fourth bottom face in the vertical direction, wherein a second height is formed between the second connecting portion and the fourth bottom face in the vertical direction, and wherein the second height is equal to the first height.

7. The combination ramp system as claimed in claim 5, wherein a bottom edge of the first ramp is provided with a third bottom face in the vertical direction, wherein a first height is formed between the first connecting portion and the third bottom face in the vertical direction, wherein a bottom edge of the second ramp is provided with a fourth bottom face in the vertical direction, wherein a second height is formed between the second connecting portion and the fourth bottom face in the vertical direction, and wherein the second height is less than the first height.

* * * * *